US010486170B2

(12) United States Patent
Hornek et al.

(10) Patent No.: US 10,486,170 B2
(45) Date of Patent: Nov. 26, 2019

(54) CENTRIFUGE ROTOR MOUNTED ON DRIVE SHAFT

(71) Applicant: ANDREAS HETTICH GMBH & CO. KG, Tuttlingen (DE)

(72) Inventors: Matthias Hornek, Tuttlingen (DE); Rainer Prilla, Messstetten (DE); Andreas Hoelderle, Doeggingen (DE); Klaus-Guenter Eberle, Tuttlingen (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 603 days.

(21) Appl. No.: 15/242,006

(22) Filed: Aug. 19, 2016

(65) Prior Publication Data

US 2017/0050195 A1 Feb. 23, 2017

(30) Foreign Application Priority Data

Aug. 20, 2015 (DE) ..... 10 2015 113 855

(51) Int. Cl.

*B04B 7/06* (2006.01)
*B04B 9/08* (2006.01)
*B04B 7/02* (2006.01)

(52) U.S. Cl.

CPC ..... *B04B 7/06* (2013.01); *B04B 9/08* (2013.01); *B04B 2007/025* (2013.01); *B04B 2009/085* (2013.01)

(58) Field of Classification Search

CPC ..... B04B 9/08; B04B 2009/085; B04B 7/06; B04B 7/00; B04B 9/00; B04B 7/08;

(Continued)

(56) References Cited

U.S. PATENT DOCUMENTS 2,329,499 A * 9/1943 Weaver ..... D01D 7/02 57/77
2,827,229 A * 3/1958 Blum ..... B04B 5/0414 464/91

(Continued)

FOREIGN PATENT DOCUMENTS

CN 2489873 5/2002
CN 205323999 6/2016

(Continued)

OTHER PUBLICATIONS

European Patent Office, European Search Report, dated Jan. 9, 2017, pp. 1-6, Application No. 16183169.8, Applicant: Andreas Hettich GmbH & Co. KG.

(Continued)

*Primary Examiner* — Charles Cooley
(74) *Attorney, Agent, or Firm* — Woodling, Krost and Rust

(57) ABSTRACT

A rotor 10 of a centrifuge 100, having a receiving chamber 18 for samples to be centrifuged, a concentrically mounted seat 20 which is associated with a support 106 of a drive shaft 104 of said centrifuge 100, a lid 40 which limits the receiving chamber 18 at the top, which is mounted concentrically relative to the rotor and which has, on its side remote from the receiving chamber 18, a handle 44 for carrying the rotor and the lid 40, and a locking mechanism 50, 34*b* of lid 40 and rotor, which locking mechanism 50, 34*b* comprises a locking element 50 which can be moved between a locking position and an unlocking position thereof. In accordance with the invention, part of the handle 44 is adapted to be movable and is operatively connected to a retaining element 48*b*, 48*c*, which retaining element 48*b*, 48*c* can be moved, by the handle 44, between a first position which prevents (Continued)

actuation of the locking element 50, and a second position which releases the locking element 50.

2 Claims, 6 Drawing Sheets

(58) Field of Classification Search
CPC ... B04B 5/0414; B04B 7/02; B04B 2007/025; F16D 1/108
USPC ..... 494/16, 12
See application file for complete search history.

(56) References Cited

U.S. PATENT DOCUMENTS 2,865,662 A * 12/1958 Nurmse ..... A01K 89/0111 242/318
3,819,111 A * 6/1974 Romanauskas ..... B04B 5/0414 494/16
3,901,434 A 8/1975 Wright
3,961,745 A * 6/1976 Wright ..... B04B 7/06 494/9
4,193,538 A * 3/1980 Schwarz ..... B04B 5/0414 494/16
4,412,830 A * 11/1983 Strain ..... B04B 7/02 494/12
4,435,169 A * 3/1984 Romanauskas ..... B04B 5/0421 494/20
4,753,631 A * 6/1988 Romanauskas ..... B04B 5/0414 494/12
4,822,331 A 4/1989 Taylor
5,342,282 A * 8/1994 Letourneur ..... B04B 9/12 384/480
5,344,380 A * 9/1994 Chern ..... B04B 5/0414 494/12
5,411,465 A * 5/1995 Glen ..... B04B 5/0414 494/16
5,681,257 A * 10/1997 Letourneur ..... B04B 9/08 403/325
5,897,482 A * 4/1999 Lowe ..... B04B 5/0414 411/424
6,056,684 A * 5/2000 Linder ..... B04B 7/02 494/12
6,063,018 A * 5/2000 Letourneur ..... B04B 9/08 403/327
6,149,570 A * 11/2000 Lowe ..... B04B 5/0414 494/12
6,665,924 B2 * 12/2003 Schutz ..... B04B 5/0414 29/525.11
6,764,438 B2 * 7/2004 Potter ..... B04B 5/0414 494/12
6,776,751 B2 * 8/2004 Potter ..... B04B 9/08 494/12
6,802,803 B2 * 10/2004 Potter ..... B04B 5/0414 494/12
6,981,304 B2 * 1/2006 Potter ..... B04B 5/0414 29/428
7,011,618 B2 * 3/2006 Potter ..... B04B 9/08 494/12
7,081,081 B2 * 7/2006 Schutz ..... B04B 9/08 494/12
7,137,198 B2 * 11/2006 Potter ..... B04B 5/0414 29/889
7,311,652 B2 * 12/2007 Henne ..... B04B 5/0414 494/12
7,419,464 B2 * 9/2008 Matusima ..... B04B 9/08 403/322.2
7,464,450 B2 * 12/2008 Potter ..... B04B 9/08 29/428
7,837,607 B2 * 11/2010 Woodman ..... B04B 5/0421 494/12
8,678,987 B2 * 3/2014 Henne ..... B04B 9/08 494/12
9,718,067 B2 * 8/2017 Ballhause ..... B04B 9/00
9,782,783 B2 * 10/2017 Bittner ..... B04B 9/08
10,300,499 B2 * 5/2019 Hornek ..... B04B 9/08
2003/0144124 A1 * 7/2003 Schutz ..... B04B 5/0414 494/12
2003/0196310 A1 * 10/2003 Potter ..... B04B 5/0414 29/428
2003/0199380 A1 * 10/2003 Potter ..... B04B 9/08 494/12
2003/0199381 A1 * 10/2003 Potter ..... B04B 5/0414 494/12
2004/0018928 A1 * 1/2004 Schutz ..... B04B 9/08 494/12
2004/0220037 A1 * 11/2004 Potter ..... B04B 5/0414 494/12
2004/0224831 A1 * 11/2004 Potter ..... B04B 5/0414 494/12
2004/0229742 A1 * 11/2004 Potter ..... B04B 9/08 494/12
2005/0221971 A1 * 10/2005 Potter ..... B04B 9/08 494/37
2006/0058169 A1 * 3/2006 Matusima ..... B04B 9/08 494/84
2006/0240963 A1 * 10/2006 Henne ..... B04B 5/0414 494/16
2008/0146429 A1 * 6/2008 Woodman ..... B04B 5/0421 494/12
2011/0212822 A1 * 9/2011 Henne ..... B04B 9/08 494/84
2013/0188894 A1 * 7/2013 Peters ..... B04B 9/08 384/91
2014/0329658 A1 * 11/2014 Le Guyader ..... B04B 9/08 494/82
2016/0015769 A1 1/2016 Li
2016/0158769 A1 * 6/2016 Hornek ..... B04B 9/08 494/83
2017/0050195 A1 * 2/2017 Hornek ..... B04B 5/0414
2017/0252754 A1 * 9/2017 Hoelderle ..... B04B 9/08
2018/0318847 A1 * 11/2018 Luersmann ..... B04B 1/08

FOREIGN PATENT DOCUMENTS

DE 2448199 2/1979
DE 9301663 U1 10/1993
DE 19930593 A1 * 4/2000 ..... B04B 9/08
DE 102013107681 A1 1/2015
DE 102014112501 3/2016
JP 2006272330 A * 10/2006 ..... B04B 5/0414
WO WO-8304379 A1 * 12/1983 ..... B04B 5/0414
WO WO-2019121214 A1 * 6/2019 ..... B04B 5/04
WO WO-2019121581 A1 * 6/2019 ..... B04B 5/0414

OTHER PUBLICATIONS

The State Intellectual Property Office of China, First Office Action, dated Aug. 29, 2018, Application No. 201610803938.6.
German Patent and Trademark Office, Search Report, dated Apr. 20, 2016,pp. 1-9, German Application No. 102015113855.7.

* cited by examiner

CENTRIFUGE ROTOR MOUNTED ON DRIVE SHAFT

This patent application claims priority to German patent application no. DE 10 2015 113 855.7, filed Aug. 20, 2015. German patent application no. DE 10 2015 113 855.7, filed Aug. 20, 2015, is incorporated herein by reference hereto in its entirety.

The invention relates to a rotor of a centrifuge as well as to a centrifuge with a rotor of this type.

BACKGROUND OF THE INVENTION

A multitude of rotors for centrifuges are known from the prior art which each have a receiving chamber that can be sealed with a lid. This protects the centrifuge and the environment from contamination in the event of a vessel rupture.

Operation safety will be increased if a mechanism is provided which locks the closure of the lid. For example, the closure can include a latching element which has an activating element provided on the top of the lid, for example a pushbutton. The latching element may furthermore be spring-loaded in a locking direction thereof so that it will automatically latch into engagement when the lid is closed, and will only be deactivated by pressing down on the pushbutton. Locking and unlocking the lid in this way is very convenient for the user.

However, practice has shown that especially with solutions of the type which enable particularly simple unlocking of the lid, there is the inherent risk of the locking device being released unintentionally. Because the lid often has a handle which can be used to carry the rotor with the lid in place. If the locking device is inadvertently deactivated in transport, the rotor will become detached from the rotor and fall to the ground.

U.S. Pat. No. 4,822,331 B discloses a centrifuge whose lid can be detached from the rotor by means of a quick-release fastener without the aid of a tool. The rotor in turn is screwed to a drive shaft. The screw can be released using a special tool. For this purpose, the tool is inserted through a pushbutton of the quick-release fastener. To prevent the pushbutton from being activated inadvertently, it is located in a recess provided in the handle. Nonetheless, even in this configuration, the pushbutton may still be pressed by accident, thus causing the lid to become detached from the rotor carried by means of the handle.

SUMMARY OF THE INVENTION

It is the object of the invention to create a rotor which avoids the above mentioned shortcomings and which has a lid with a handle for carrying the rotor with the lid in place, wherein said rotor and lid are adapted to be interlocked by means of a quick-release fastener and the locking is secured against being released for as long as the rotor is carried by means of the handle.

The invention is based on the finding that by securing the locking of the rotor to the lid in the handle, the above mentioned disadvantages can be avoided in a simple manner.

In accordance with the invention, the rotor of a centrifuge comprises a receiving chamber for samples to be centrifuged, a concentrically mounted seat which is associated with a support of a drive shaft of the centrifuge, a lid which delimits the receiving chamber at the top and which is concentrically mounted with respect to the rotor and on whose far side, with respect to the receiving space, a handle is provided for carrying the rotor and the lid is provided. Furthermore, the rotor includes a locking mechanism for locking the lid onto the rotor, which locking mechanism comprises a locking element that can be moved between a locking position and an unlocking position thereof and which is provided in the form of a quick-release fastener. No additional tool is required for the quick-release fastener. In accordance with the present invention, the handle is designed to be partially movable and is operatively connected to a retaining element which can be moved, by means of the handle, between a first position thereof which prevents actuation of the locking element, and a second position thereof which releases the locking element. This allows the handle to be fixed in a position, preferably for carrying the rotor, in which the retaining element is activated so that actuating the locking element will be prevented and the locking mechanism will thus remain in either the locking position or the unlocking position until the position of the handle is changed again. This contributes to avoiding user errors and improves the safety of the rotor.

In an advantageous embodiment of the invention, the retaining element is designed as a cover element which, in an activated state thereof, prevents access to the locking element, and/or the retaining element is designed as a blocking element which, in an activated state thereof, fixes the locking element in a locking position thereof. If activation of the cover element and/or of the blocking element has been chosen appropriately, this will prevent unintentional release of the locking mechanism in transport, thus preventing the rotor from falling off, which improves the safety of the rotor considerably.

In one aspect of the invention, the lid includes a support for the locking element. This stabilizes the locking mechanism, thus reducing the incidence of errors.

It is very advantageous for the support to be mounted concentrically relative to the bearing body which is located in the lid and which is firmly connected thereto, which bearing body more specifically takes the form of a cylinder. This will further increase the stability of the locking mechanism.

It is expedient to mount the handle concentrically with respect to the bearing body and to adapt it to be movable relative to the bearing body. The handle can thus be given an additional function which it fulfils when it is being moved relative to the bearing body. For example, the handle can be connected to a further element in such a way that moving the handle in the one direction will activate said element and moving the handle in the respective other direction will deactivate said element.

The handle is preferably integrally formed with the activatable blocking element and adapted to be movable, together with the blocking element, relative to the bearing body, between a first position which blocks the locking element in a locking position and a second position which releases the locking element. It should be noted here that moving the locking element from the locking position into the unlocking position will only be possible when the locking element is in the second position.

In accordance with an embodiment of the invention, it has proven advantageous to displace the handle from the first position to the second position and vice versa along the rotor axis on the bearing body. Because the handle will also be moved along the axis of rotation for inserting the rotor into the centrifuge as well as for removing the rotor from the centrifuge, displacing the handle for activating/deactivating the blocking element and displacing the handle for removal/ insertion will be coaxial movements. This will save the user an additional movement, thus facilitating operation of the rotor.

It is expedient for a movement of the handle together with the blocking element away from the lid to correspond to a movement into the first position, and a movement of the handle together with the blocking element towards the lid to correspond to a movement into the second position. Provided the locking element has not been previously moved into the unlocking position, lifting the handle will thus activate the blocking element, and the rotor will be lifted together with the lid. Owing to the force of gravity acting on the rotor, the handle with the blocking element will remain in the first position remote from the lid, which position blocks the locking element and thus prevents it from being inadvertently released. This arrangement thus ensures reliable blocking of the locking elements and considerably increases the safety of the rotor in transport.

In an advantageous embodiment of the invention, the handle is spring-loaded in the direction of the lid. This will cause the handle together with the blocking element to automatically move into the second position as soon as the rotor is inserted into a centrifuge or placed on a surface, the operator releases the handle and thus no force is exerted on the handle any more in a direction away from the lid. The locking element can then be moved into an unlocking position. This automatic movement of the handle saves the user another movement which in turn facilitates operation of the rotor.

In one aspect of the invention the locking mechanism reaches through part of the handle, in particular on a side thereof. This makes the locking mechanism readily accessible which increases the ease of use of the rotor. At the same time, it will be easier to distinguish activation/deactivation of the locking mechanism and of the blocking device from each other haptically. These two actions can be distinguished from each other particularly well if the directions of activation of the locking mechanism and the blocking device are at approximately right angles to each other. This further increases the safety of the rotor.

In another embodiment of the invention, the locking element is a tilt lever. Tilt levers are well suited for interlocking two components in a way that can be released without difficulty, and are easy to install. This reduces both the design effort as well as the costs. In addition, tilt levers can be used to bridge spaces in a vertical direction, thus resulting in further options for optimizing the design.

It is considered advantageous for the tilt lever to be spring-loaded in the direction of the locking position. This will ensure secure automatic locking of the lid when placed onto the rotor and thus facilitates operation of the rotor.

In an advantageous embodiment of the invention, the lower end of the tilt lever is provided in the form of a latching element which, in the locking position, will engage a groove provided in the rotor and which is open towards the receiving chamber. Pressing down on the upper end of the tilt lever will release the lever from the locking position. The dimensions of the one or plural tilt lever(s), their supports and the arrangement of the tilt axis can easily be chosen such that a locking action is obtained which is first of all sufficiently stable to safely transport the rotor via the handle of the locked lid and which, secondly, can be released quickly by the operator after transport. As a result, the lid and the rotor will be interlocked in a safe and at the same time flexible manner.

In another aspect of the invention, a blocking device is provided for fixing the rotor relative to the drive shaft of the centrifuge, in which an activating element is mounted in the lid for activating the blocking device, which element will be accessible when the lid is in place. Consequently, the blocking device can be activated and deactivated without first having to remove the lid from the rotor. This is of particular advantage, for example, if contamination of the environment has to be prevented after a vessel has ruptured inside the rotor. The rotor can then be disconnected from the drive shaft and removed from the centrifuge with the lid still in place. This will ensure even safer operation of the rotor.

Preferably, the blocking device includes a blocking unit which can be moved between a blocking position and a release position thereof by means of the activating element. The activating element can easily be integrated into a simple pushing or sliding mechanism. This is an inexpensive way of achieving secure locking and unlocking of the rotor with only little constructional effort.

In an advantageous embodiment of the invention, the blocking unit is spring-loaded in the direction of the blocking position. This blocking device will thus be activated into the blocking position by the insertion of the rotor, without any additional manual action.

It is advantageous for the activating element to be capable of being actuated in a direction parallel to a rotor axis. As a result, locking and unlocking of the rotor will be in parallel to the direction in which the rotor is inserted into the centrifuge and/or the rotor is removed from the centrifuge. The activating element can thus be integrated even more easily into the rotor, thus minimizing the risk of the blocking device getting jammed.

In order to further facilitate the use of the rotor for the operator, it has proven advantageous to support at least part of the activating element in the handle. This facilitates one-handed activation of the activating element since the handle will simultaneously function as a guide for the activating element and as a support for the operator's hand.

Preferably, on the far end of the activating element, with respect to the blocking unit, a pushbutton is provided, at least part of which will be outside the handle when the activating element is in the blocking position. The longitudinal extension of the pushbutton portion which is outside the handle will correspond to at least a lifting height h required to unlock the blocking device. Thus the blocking device can be deactivated by a simple pressing action which is particularly convenient for the user.

According to the invention, a centrifuge is furthermore provided which comprises a drive and a drive shaft, which latter has the seat of a support for a rotor as mentioned above abutting on its free end.

In one aspect of the invention, the blocking device has a blocking body which cooperates with the blocking unit and thus fixes the rotor in position relative to the drive shaft. This increases the blocking action of the blocking device and makes operation of the centrifuge clearly safer.

In an advantageous embodiment of the invention, the blocking body is provided on the seat of the rotor, at least partially engages the support through a recess provided in the support and, in a blocking position, is embraced by the blocking unit in such a way that the outer circumference of the blocking unit embracing the blocking body will be larger than the inner circumference of the recess. This will reliably fix the rotor in position relative to the drive shaft without major constructional effort, thus considerably increasing the safety of the centrifuge.

Additional advantages, features and possible applications of the present invention can be gathered from the description which follows, in which reference is made to embodiments illustrated in the drawings.

Throughout the description, claims and drawings, those terms and associated reference signs are used as are listed in the List of Reference Signs which follows below.

DESCRIPTION OF THE INVENTION

Figure 1:
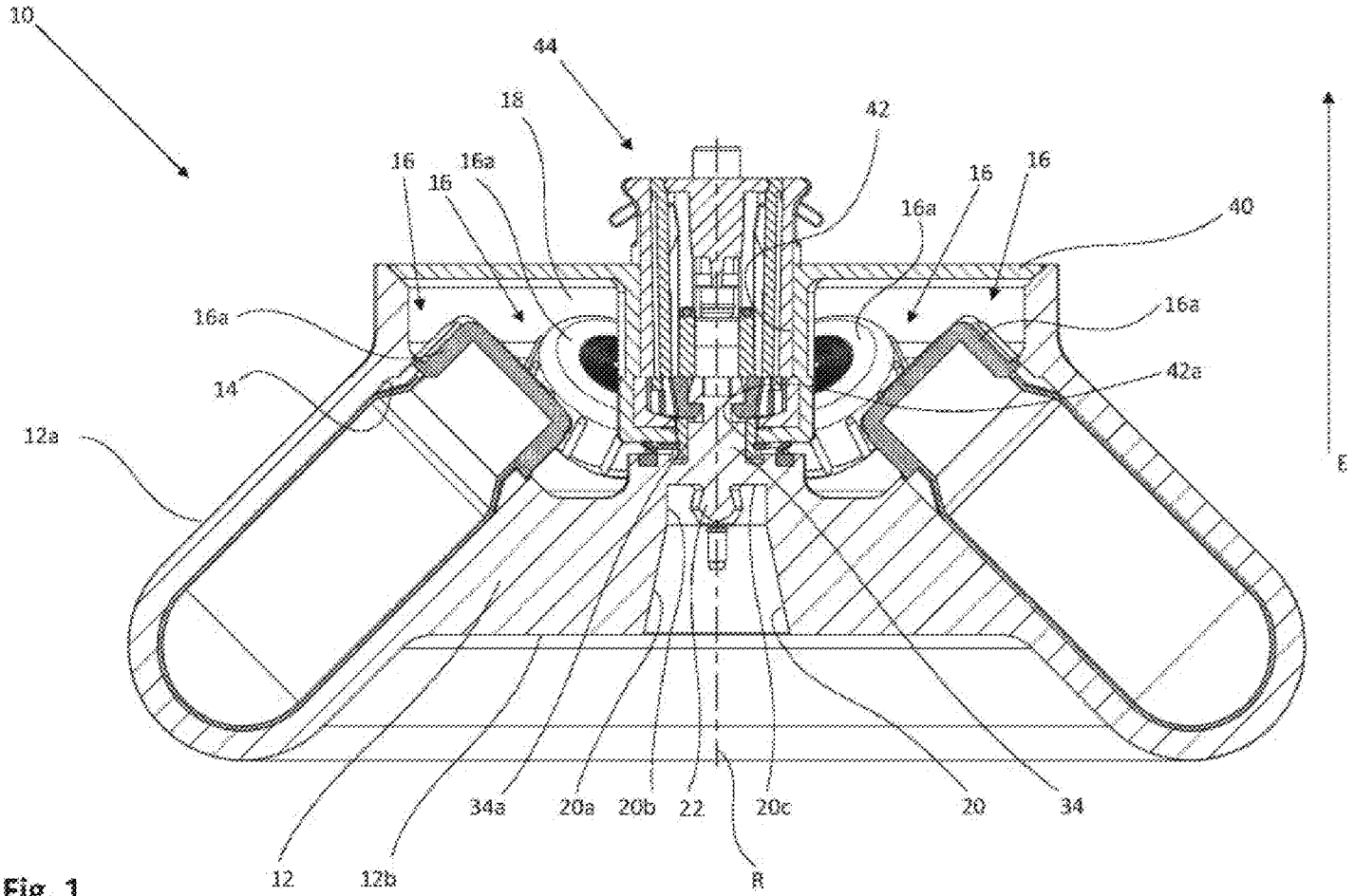
FIG. 1 is a lateral sectional view of a rotor of the invention with the lid in place, in which the locking of the lid has been activated (section through the rotor axis)

FIG. 1 is a lateral sectional view of a rotor 10 according to the invention with the lid 40 in place and activated locking of the lid 40.

The rotor 10 has the basic shape of a truncated cone which tapers toward the top. Provided in a rotor head 12 in a conventional manner and uniformly spaced from each other are receiving units 14 for sample containers 16. The longitudinal extension of the receiving units 14 is parallel to the lateral surface 12*a* of the rotor head 12. The view of FIG. 1 shows four sample containers 16 inserted in the receiving units 14. Sealing caps 16*a* of the sample containers 16 protrude from the respective receiving units 14 into a receiving chamber 18 of the rotor 10.

Mounted concentrically in a bottom 12*b* of the rotor head 12 is a rotor seat 20 which is associated with the support 106 of the centrifuge 100. The rotor seat 20 has a frusto-conical first portion 20*a* which tapers in a removal direction E and which is adjoined in an axial direction by a cylindrical second portion 20*b*. The upper boundary of the rotor seat 20 is a boundary surface 20*c* which is perpendicular to the rotor axis R. Concentrically mounted on this boundary surface 20*c* is a locking ball 22 which faces the support 106 of the centrifuge 100 and extends away from the boundary surface 20*c* along the rotor axis R and whose function will be explained in more detail below with reference to FIGS. 3, 3*a* and 3*b*.

Above the locking ball 22, a rotor pin 34 is mounted within the receiving chamber 18 which is concentric relative to the rotor axis R and which has an external contour 34*a* that conically tapers towards its free end. The rotor pin 34 is shown in more detail in FIG. 3, and in particular in the enlarged detail of FIG. 3*a*.

Placed on the rotor 10 is a lid 40 which seals the receiving chamber 18 from the outside in an aerosol-tight manner. Mounted concentrically relative to the lid 40 is a handle 44 which is used to place the lid 40 on the rotor 10 and to remove the lid 40 from the rotor 10. Part of the handle 44 is inserted in a blind-hole shaped recess 42 of the lid 40 and firmly connected to the latter in a conventional manner. The recess 42 has an aperture 42*a* which is concentric to the rotor axis R and provided in the cylindrical bottom of the recess, and through which the free end of the rotor pin 34 engages the handle 44.

Figure 2A:
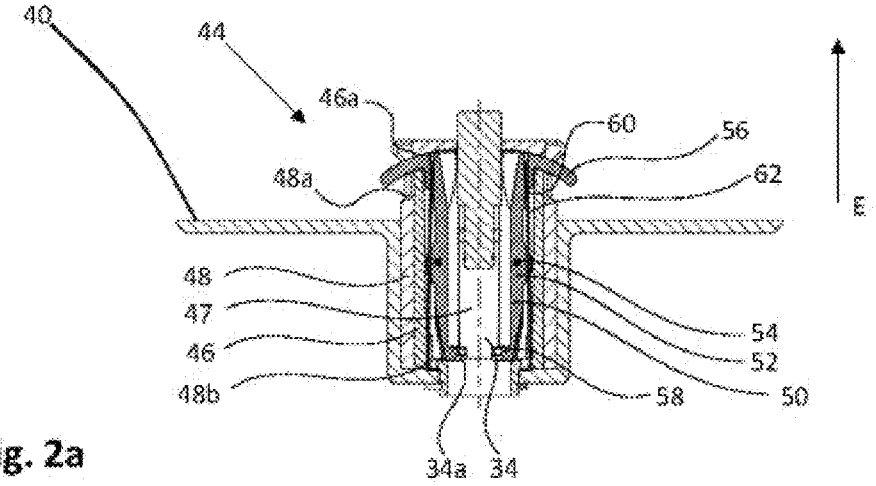
FIG. 2*a* is a lateral sectional view of the lid of FIG. 1, in which locking has been activated and blocking has been deactivated.
Figure 2B:
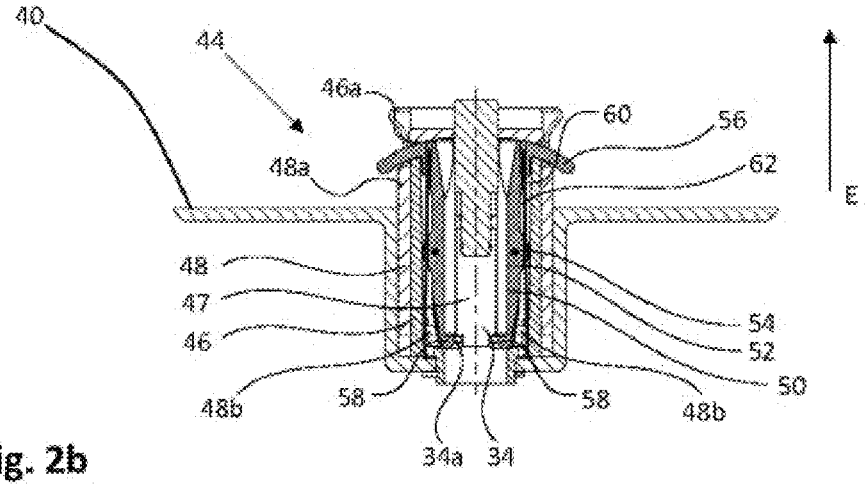
FIG. 2*b* is a lateral sectional view of the lid, in which both locking and blocking have been activated.
Figure 2C:
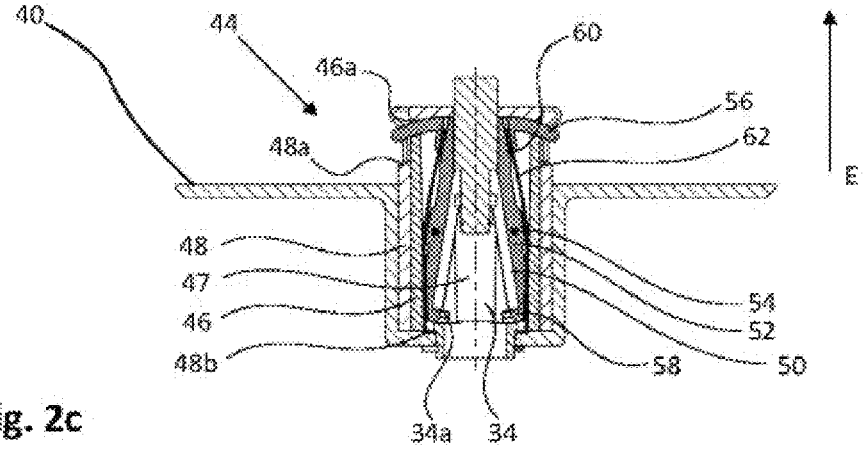
FIG. 2*c* is a lateral sectional view of the lid, in which both locking and blocking have been deactivated.

For the sake of clarity, the handle 44 is shown in enlarged detail in FIGS. 2*a*, 2*b* and 2*c*. The handle 44 has a cylindrical bearing body 46 which has a wall 48 mounted on its outer wall for movement in an axial direction. Within the bearing body 46, two tilt levers 50 are mounted opposite each other relative to the rotor axis R. The longitudinal extension of the tilt levers 50 is essentially aligned axially. Provided approximately in the middle of the cross-section of the tilt levers 50 is a thickened portion 52 which points towards the bearing body 46 and which is rounded. A strut 54 each (not shown for reasons of clarity) runs through these thickened portions 52 about which the tilt levers 50 can be tilted. The strut 54, together with its associated recess in the thickened portion 52, thus forms a tilt joint for the tilt levers with respect to the bearing body 46 and the wall 48 which completely surrounds at least parts of the latter. On the upper end of the tilt lever 50, there is an actuating member 56 which faces in a direction away from the rotor axis R. Moreover, each tilt lever 50 tapers in cross-section towards the upper end. Each tilt lever 50 also tapers in cross-section towards the lower end, on which a latching element 58 each pointing towards the rotor axis R is mounted on the tilt lever 50.

The actuating members 56 each have an associated recess 46*a* in the bearing body 46 and a recess 48*a* in the wall 48 through which part of the actuating members 56 protrudes laterally from the handle 44.

At the upper end of each tilt lever 50 is a recess 60 each which is engaged by an end of a spring 62, more specifically a leaf spring, which is arranged along the bearing body 46 of the handle 44. The ends of the springs 62 which are remote from the recesses 60 are clamped onto the bearing body 46 and radially preloaded toward the outside. The spring 62 will thus urge the upper ends of the tilt levers 50 radially outwards, if, as shown in FIG. 2*a*, no force is applied manually from the outside, and into abutment on the bearing body 46, and the actuating members 56 will protrude laterally from the handle 44 to a maximum extent. At the same time, the tilt levers 50 will be tilted about the struts 54 in such a way that the lower ends will be spaced from the bearing body 46. The latching elements 58 will latch into engagement with a circumferential groove 35*b* made in the external contour 34*a* of the rotor pin 34. In this position of the tilt levers 50 as shown in FIG. 2*a*, the rotor 10 and the lid 40 are locked together.

FIG. 2*b* is a view of the handle 44 with the tilt levers 50 in the same position as in the view of FIG. 2*a*, i.e. the locking position. Here, the wall 48 of the handle 44 has been moved axially relative to the bearing body 46 in the removal direction E. This relative change in position of the wall 48 with respect to the bearing body 46 is brought about by an operator grasping the handle 44 and lifting it without releasing the locking of lid 40 to rotor 10, rather than applying force to the actuating members 56 so as to tilt the tilt levers 50 and release the latching elements 58 from the groove 34*b* made in the external contour 34*a* of the rotor pin 34.

As the wall 48 changes position, a projection 48*b* which is located on the end of the wall 48 that points in the direction of the receiving chamber 18, and which extends in the direction of the rotor axis R and which reaches through a recess (not shown) in the bearing body 46 will also be entrained. Lifting the wall 48 in the removal direction E will cause the projection 48*b* to abut on the tilt lever 50 in the area between the thickened portion 52 and the latching element 58. This will block the tilt lever 50 so as to prevent it from tilting about the strut, and the latching element 58 will thus be secured within the groove 34*b*. The locking between the rotor 10 and the lid 40 cannot be released in this blocking position.

A spring not shown here for the sake of clarity applies a force to the wall 48, which force acts against the removal direction E. As soon as the operator sets down the rotor 10 or places it inside a centrifuge 100, which will neutralize the weight force acting on the handle 44, the wall 48 will return to its initial position, and the blocking of the tilt levers 50 by each projection 48*b* will be released. The projection 48*b* of the wall 48 thus constitutes a safety element which either blocks or releases actuation of the tilt lever 50, as required, depending on its respective position.

Figure 3:
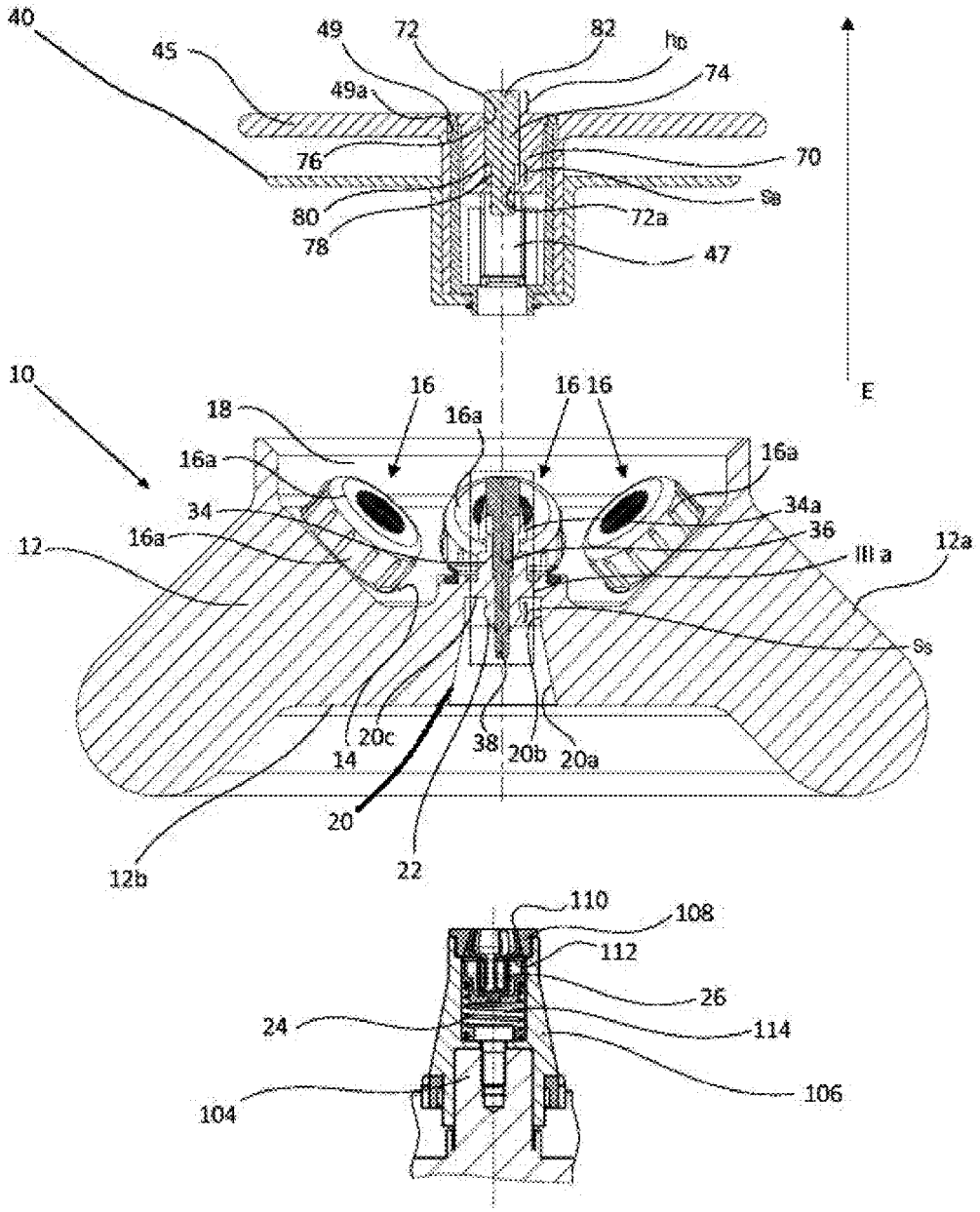
FIG. 3 is an exploded lateral sectional view of the rotor of FIG. 1 with the lid removed, and of the rotor receiving chamber of the drive shaft of a centrifuge.
Figure 3A:
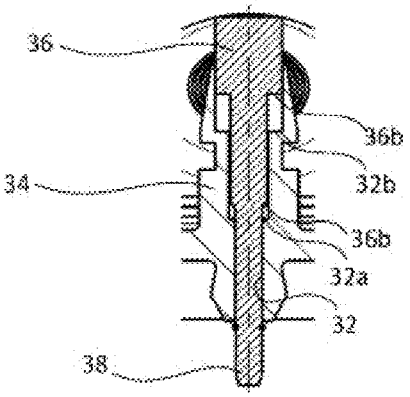
FIG. 3*a* is an enlarged view of a detail marked III a in FIG. 3.

As can be seen in FIG. 3, a bent free end 49 of the bearing body 46 and a shoulder 49*a* associated with the free end 49 and formed in the wall 48 together form a stop, thus limiting the axial displacement of the wall 48 on the bearing body 46.

In FIG. 2*c*, the wall 48 of the handle 44 is illustrated in its initial position again. The projection 48*b* is again below the tilt levers 50, which thus eliminates the blocking of the tilt levers 50 as shown in FIG. 2*b*. As a result of a manual force exerted on the actuating members 56, the tilt levers 50 are tilted about their tilt joints formed by a strut 54 and respective associated recess in the thickened portion 52, and the latching elements 58 are outside the groove 34*b*. The locking between the rotor 10 and the lid 40 has been released, and the lid 40 can be removed from the rotor 10.

Figure 6:
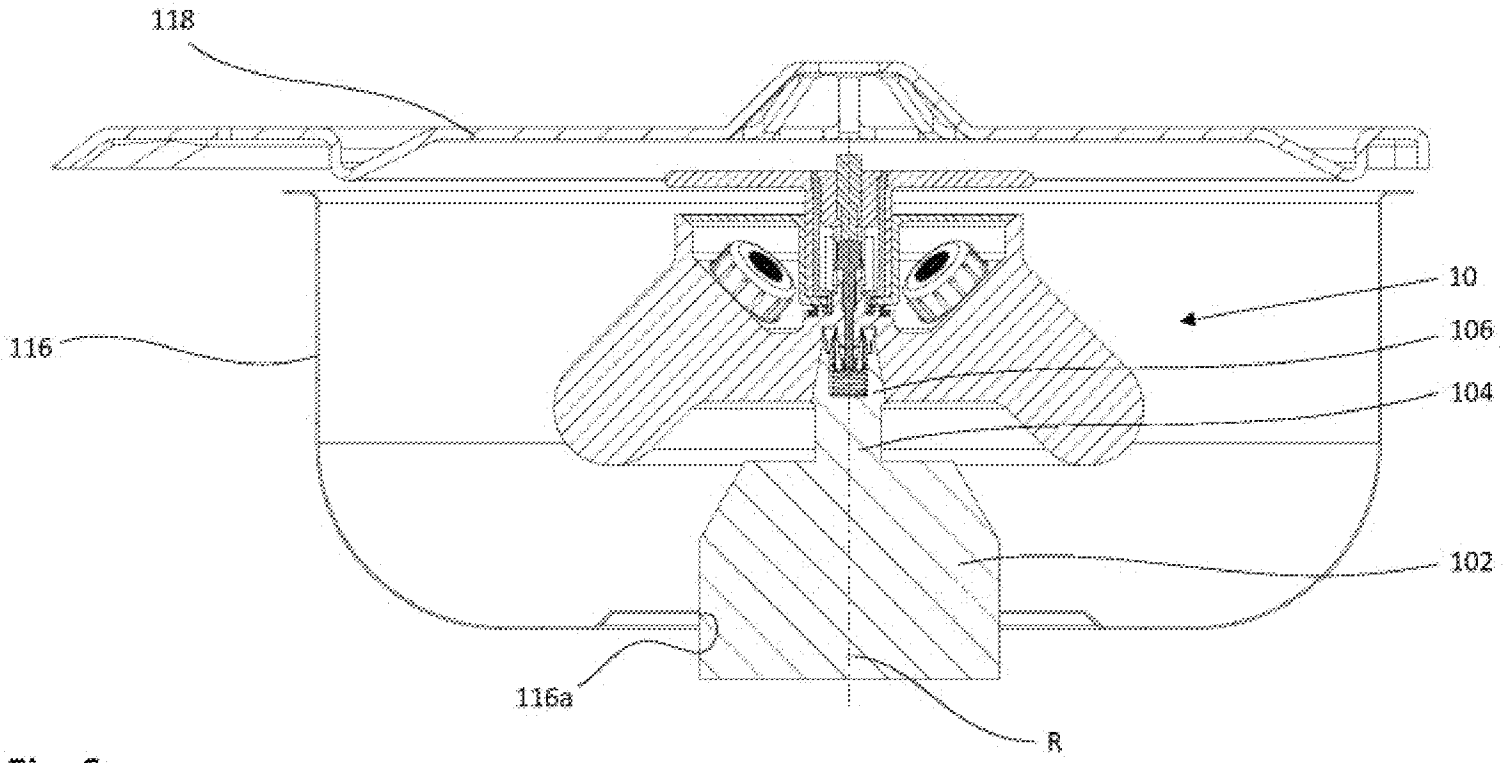
FIG. 6 is a lateral sectional view of a centrifuge according to the invention.

FIG. 3 is an exploded lateral sectional view of the rotor 10—rotated by 90° relative to the views of FIG. 1 and FIGS. 2*a* to 2*c*—i.e. an exploded view with the lid 40 removed, as well as of a support 106 of a centrifuge 100 which is also shown schematically in FIG. 6.

When the rotor 10 is placed onto the support 106 of the centrifuge 100, the locking ball 22 will engage an aperture 110 of an abutment insert 108 which is concentrically arranged on the support 106 and screwed together with the latter. The aperture 110 is dimensioned so as to allow passage of the locking ball 22 with minimum clearance. Following after the aperture 110 is an internal contour 112 of the abutment insert 108 which widens conically in a direction opposite to the direction of removal E.

Figure 3B:
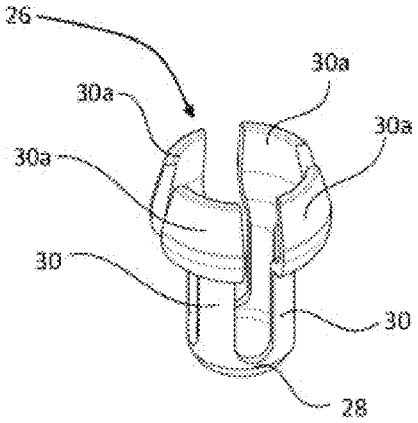
FIG. 3*b* is a perspective view of a blocking element.

Arranged in a cylindrical inner area 114 of the support 106 is a spring 24 in which a blocking unit 26 is mounted to which a spring force is applied which acts in the removal direction E, which blocking unit 26 is separately shown in FIG. 3*b* for reasons of clarity. The blocking unit 26 has four blocking springs 30 which are interconnected via a connecting ring 28 and each have a blocking element 30*a* mounted on their respective ends. The shape of the blocking elements 30*a* is essentially adapted to the external contour of the locking ball 22. Placing the rotor 10 onto the support 106 of the centrifuge 100 will cause the blocking elements 30*a* and thus the entire blocking unit 26 to be initially pressed downward, by the locking ball 22 entering the aperture 110, into the area of the internal contour 112 in the abutment insert 108 which is larger than the aperture 110 so that the blocking elements 30*a* can then be pressed apart. The blocking elements 30*a* then slide along the locking ball 22 to the point where they will ultimately surround the locking ball 22 with the rotor 10 completely in place on the support 106. The spring force will cause the blocking unit 30 to again move in the removal direction E, and the blocking elements 30*a* will abut on the internal contour 112 of the abutment insert 108. With the blocking elements 30*a* in abutment, the circumference of the locking ball 22 with the blocking elements 30*a* will increase to such an extent that it will no longer be able to pass through the aperture 110 of the abutment insert 108. The abutment of the blocking elements 30*a* on the internal contour 112 of the abutment insert 108 will thus prevent any movement of the blocking elements 30*a* in a radial direction. The rotor 10 is thus securely fixed in an axial direction on the support 106 of the centrifuge 100.

The locking ball 22 is penetrated by a bore 32. The bore 32 extends from the locking ball 22 through the rotor head 12 and the adjacent rotor pin 34. As viewed in the removal direction E, the inner diameter of the bore 32 widens at a first shoulder 32*a* and again at a second shoulder 32*b*.

Reaching through the bore 32 is an unlocking pin 36 which in turn has a first shoulder 36*a* which is associated with the first shoulder 32*a* of the bore 32, and a second shoulder 36*b* which is associated with the second shoulder 32*b* of the bore 32. For reasons of clarity, the area marked III a in FIG. 3 which shows the unlocking pin 36 inserted in the bore 32 is illustrated in enlarged detail in FIG. 3*a*. In the areas respectively associated with each other, the diameter of the unlocking pin 36 and the internal diameter of the bore 32 are adapted to each other so as to allow axial movement of the unlocking pin 36 within the bore 32. Axial movement of the unlocking pin 36 in the direction of the support 106 is limited and possible up to a final position in which the respective corresponding shoulders 32*a* and 36*a* as well as the shoulders 32*b* and 36*b* will then abut on each other.

The longitudinal extension of the unlocking pin 36 is dimensioned such that a free end 38 thereof will be made to protrude from the locking ball 22 as the unlocking pin 36 is moved against the removal direction E, will engage the blocking unit 26 and increasingly displace the blocking unit 26 against the force of the spring 24, with the blocking elements 30*a* also moving along the locking ball 22 into the area of the internal contour 112 which is wider than the aperture 110 of the abutment insert 108, thus allowing the blocking elements 30*a* to bend outwardly. Once unlocking pin 36 reaches the above described final position, the blocking unit 26 has been moved by a distance $s_S$ to such an extent that the blocking elements 30*a* will completely release the locking ball 22, i.e. as the locking ball 22 passes the blocking elements 30*a*, the latter will be bent radially outwardly. The locking ball 22 will then be able to pass through the aperture 110 of the abutment insert 108 again, and the rotor 10 can be taken off the support 106 of the centrifuge 100.

It is also conceivable to interchange the positions of the locking ball 22 and of the blocking unit 30, i.e. to have the locking ball 22 arranged on the side of the shaft, to mount the blocking unit 30 for axial movement in the rotor 10, with the internal contour 112 of the abutment insert 110 consequently tapering in the removal direction E.

For activating the unlocking pin 36, an actuating pin 74 is provided in the handle 44, which—together with the unlocking pin 36—forms an activating element 36, 74.

For this purpose, a support insert 70 is incorporated in the bearing body 46 of the handle 44, concentrically to the rotor axis R, which is flush with the handle pieces 45 on the side facing away from the rotor 10. An axial bore 72 runs through the support insert 70 and tapers in steps at the end facing the rotor 10 so as to form an aperture 72*a* there which is smaller in diameter than the diameter of the bore 72.

The actuating pin 74 is movably mounted within the bore 72 and comprises a cylindrical first portion 76 which is adapted in diameter to the internal diameter of the bore 72, as well as a cylindrical second portion 78 which is adapted in diameter to the internal diameter of the aperture 72*a*. The second portion 78 runs through the aperture 72*a* and engages an inner space 47 of the handle 44 which is delimited laterally by the bearing body 46. A shoulder 80 formed between the first portion 76 and the second portion 78 thus serves as a boundary for axially moving the actuating pin 74 into a final position, against the removal direction E.

The free end of the first portion 76 is designed as a pushbutton 82 which, in its non-depressed state, will project completely from the support insert 70 and is of a height $h_D$. When the pushbutton 82 is completely depressed, it will be flush with the free side of the support insert 70, and the actuating pin 74 will be moved against the removal direction E by a distance $s_B$ which corresponds to the height $h_D$. The actuating pin 74 is thus moved into its above described final position.

As the lid 40 is placed onto the rotor 10, the rotor pin 34 housing the unlocking pin 36 will enter the inner space 47 of the bearing body 47 of the handle 44 through the aperture 42*a*. Centering the lid 40 will be facilitated by the conically tapering external contour 34*a* on the free end of the rotor pin 34.

The lengths of the unlocking pin 36 and the actuating pin 74 have been chosen such that their ends which face each other will abut on each other once the lid 40 is completely in place on the rotor 10. Thus the unlocking pin 36 and the actuating pin 74 together form an activating element 36, 74 which can be used to move the blocking unit 26 axially by the distance $s_S$ into a release position even with the lid 40 in place, and the lock between the rotor 10 and the shaft 104 can be deactivated in the manner described above, thus allowing the rotor 10 to be taken off the support 106.

In the present embodiment, the height $h_D$ of the pushbutton 82 is of the same length as the distance $s_B$ and the distance $s_S$. The pushbutton 82 may also be designed to be higher, in which case it will also protrude from the support insert 70 in its activated state. However, the height $h_D$ must not be smaller or not much smaller than the length of the distances $s_B$ and $s_S$, else the required lifting height of the blocking unit 26 for unlocking will not be obtained and unlocking cannot be reliably ensured anymore.

Similarly, it is possible to form the activating element 36, 74 as one piece and optionally either mount it in the handle 44 of the lid 40 or in the receiving chamber 18 of the rotor 10, in the rotor pin 34. When the activating element 36, 74 is mounted in the handle 44, the rotor pin 34 can be of a more space-saving design, or the rotor pin 34 can almost completely be omitted.

Figure 4:
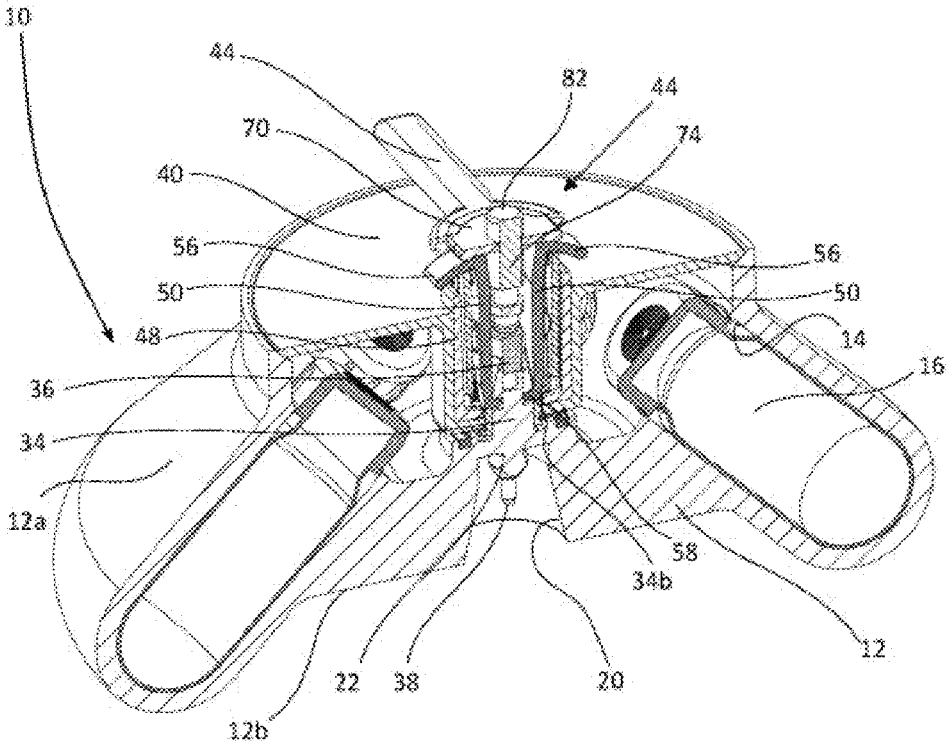
FIG. 4 is a perspective sectional view of the rotor, similar to the view of FIG. 1.

The perspective view of FIG. 4 illustrates how the locking mechanism 50, 34*b* for interlocking the lid 40 and the rotor, and the blocking device 22, 24, 26 for securing the rotor 10 to the drive shaft 104 are embedded in the handle 44. The operator will thus only need one hand to operate the two unlocking means, and will not have to change the position of his hand much, either. Since the pushbutton 82 will have to be pressed down vertically to unlock the blocking device 22, 24, 26 which secures the rotor 10 to the shaft 104, whereas unlocking the device which secures the lid 40 to the rotor 10 is accomplished by exerting horizontal pressure on both sides of the two actuating members 56, the risk of incorrect use is low.

Similarly to FIGS. 2*a*, 2*b* and 2*c*, FIGS. 5*a*, 5*b* and 5*c* are detailed views of the handle 44 incorporated in the lid 40 with a retaining device which, in its activated state, will prevent access to the locking element 50.

As already described, the lid 40 is locked by means of the tilt levers 50. On the lower end of each tilt lever 50, a latching element 58 is provided which, in a locked state of the lid 40, will engage the groove 34*a* made in the rotor pin 34. This will secure the lid 40 axially to the rotor pin 34 and thus lock it together with the rotor 10.

The tilt levers 50 are pivotably supported on the struts 54. Exerting a force on the actuating members 56 arranged on the upper ends of the tilt levers 50 in the direction of the rotor axis R will cause the tilt levers 50 to be tilted for unlocking in such a way that the latching elements 58 will slide out of the groove 34*a*, thus releasing the secure connection of the lid 40 to the rotor pin 34.

As also already described with reference to FIGS. 2*a*, 2*b* and 2*c*, lifting the handle 44 will activate the retention of the locking. This will cause the wall 48 and the projections 48*b* mounted on the wall 48 to be moved axially in the removal direction E. As a result, a projection 48*b* each will be made to abut on its associated tilt lever 50, thus blocking any movement of the tilt levers 50. The latching element 58 will be locked in the groove 34*b*, and the locked connection of the lid 40 to the rotor 10 will be secured.

The difference to the embodiment shown in FIGS. 2*a*, 2*b* and 2*c* is that cover elements 48*c* are additionally provided as a precaution against unintentional releasing of the locked connection.

Figure 5A:
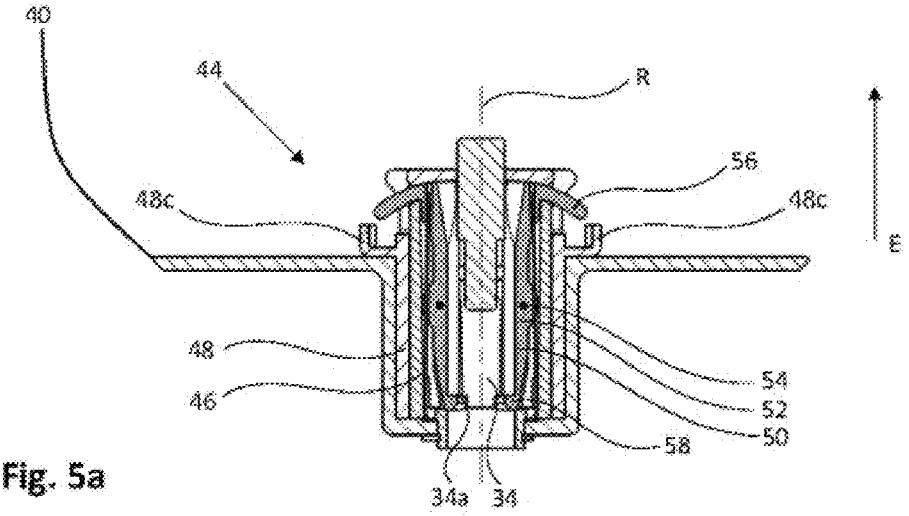
FIG. 5*a* is a lateral sectional view of the lid with activated locking and deactivated cover according to an alternative embodiment.

The cover elements 48*c* mounted on the free end of the wall 48 and facing away from the rotor axis R, together with the wall 48 of the handle 44, feature a U-shaped cross-section which is open toward the top. The cover elements 48*c* are dimensioned such that their free ends which point upwards will reach up to below the actuating members 56 when the handle 44 is in its non-actuated initial position, as shown in FIG. 5*a*. The actuating elements 56 are freely accessible in this state.

Figure 5B:
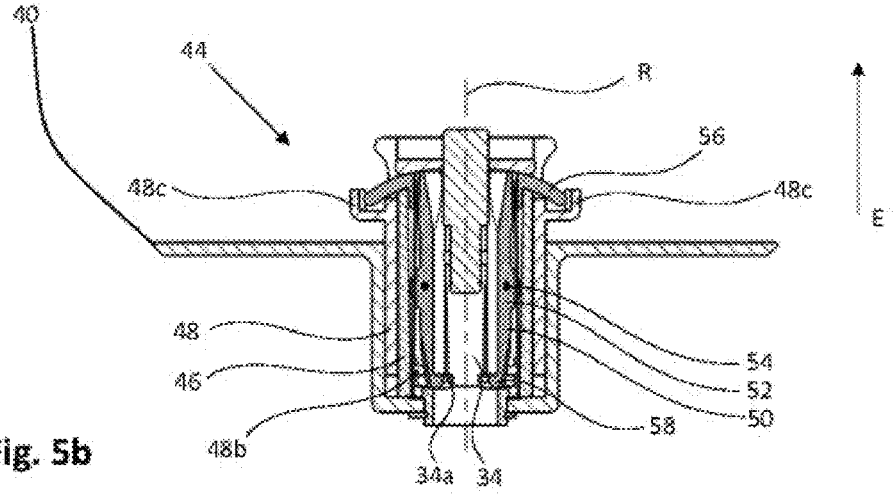
FIG. 5*b* is a lateral sectional view of the lid with activated locking and activated cover according to said alternative embodiment.

The view of FIG. 5*b* shows the tilt levers 50 in an identical position as the one of FIG. 5*a*, the locking position. Here the wall 48 of the handle 44, together with projections 48*b* and cover elements 48*c*, have been axially displaced relative to the bearing body 46 in the removal direction E. The actuating elements 56 each engage the area between the cover element 48*c* and the wall 48 such that their free ends will no longer be freely accessible, thus preventing any exertion of a manual force by an operator and consequent release of the locked connection of the lid 40 to the rotor 10. The locked connection will thus be secured against faulty operation both by the blocking of the movement of the tilt levers 50 and by a cover of the actuating members 56.

Figure 5C:
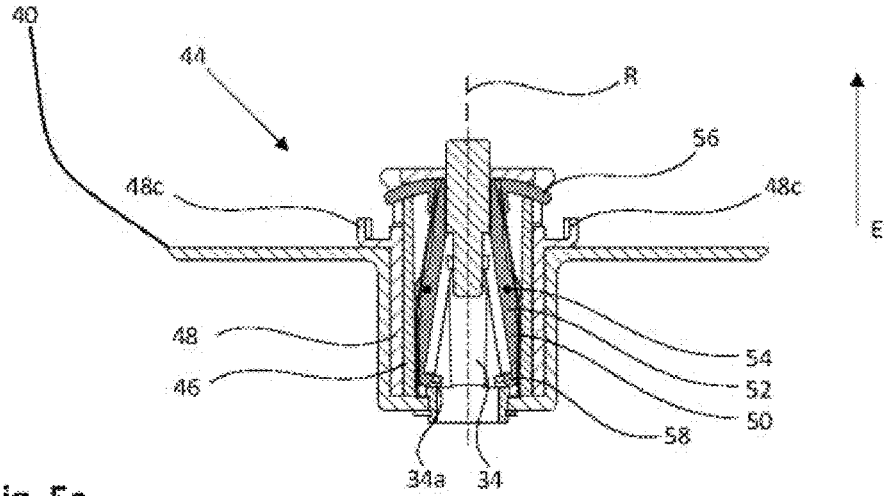
FIG. 5*c* is a lateral sectional view of the lid with deactivated locking and deactivated cover according to said alternative embodiment.

Finally, FIG. 5*c* is a view of the wall 48 of the handle in its initial position again in which the cover elements 48*c* are again located below their associated actuating elements 56. Owing to a manual force exerted on the actuating members 56, the tilt levers 50 are now tilted in such a way that the latching elements 58 are outside the groove 34*a*, in the unlocking position.

FIG. 6 is a lateral sectional view of a centrifuge 100 according to the invention, from which a housing and a bottom have been omitted for reasons of clarity.

As already described with reference to FIG. 3, the rotor 10 illustrated in FIGS. 1 to 4 is connected to the drive shaft 104 via the support 106 and rotates about rotor axis R. The drive shaft 104 is driven by the motor 102 underneath it.

For safety and soundproofing reasons, the rotor 10 is surrounded by a safety vessel 116. The motor 102 engages the safety vessel 116 via an aperture 116*a*.

Provided above the safety vessel 116 is a centrifuge lid 118 which is connected to the housing (not shown) in a conventional manner and seals the centrifuge 100 at its top.

LIST OF REFERENCE SIGNS

10 rotor
12 rotor head
12*a* lateral surface
12*b* bottom
14 receiving units
16 sample containers
16*a* sealing caps
18 receiving chamber
20 rotor seat
20*a* first portion
20*b* second portion
20*c* boundary surface
22 locking ball
24 spring
26 blocking unit
28 connecting ring
30 blocking springs
30*a* blocking elements
32 bore
32*a* first shoulder
32*b* second shoulder
34 rotor pin
34*a* external contour
34*b* groove
36 unlocking pin
36*a* first shoulder
36*b* second shoulder
38 free end
40 lid
42 recess
42*a* aperture
44 handle
45 handle pieces
46 bearing body
46*a* recess
47 inner space
48 wall
48*a* recess
48*b* projection
48*c* cover element
49 free end
49*a* shoulder
50 tilt lever
52 thickened portion
54 strut
56 actuating member
58 latching element
60 recess
62 springs
70 support insert
72 bore
72*a* aperture
74 actuating pin
76 first portion
78 second portion
80 shoulder
82 pushbutton
100 centrifuge
102 motor
104 shaft
106 support
108 abutment insert
110 aperture
112 internal contour
114 inner area
E removal direction
R rotor axis
$h_D$ pushbutton height
$s_B$ activation distance of actuating pin
$s_S$ activation distance of blocking unit

What is claimed is:

1. A rotor (10) of a centrifuge (100), comprising:
a receiving chamber (18) for samples to be centrifuged;
said receiving chamber (18) includes a top;
said centrifuge includes a drive shaft (104);
said drive shaft (104) includes a support (106) mounted thereon;
a concentric seat (20) concentrically mounted on said support (106) of said drive shaft (104) of said centrifuge (100);
a lid (40);
said lid includes a remote side facing away from said receiving chamber (18);
said lid (40) limits said receiving chamber (18) at said top when said lid (40) is mounted concentrically with said rotor in said receiving chamber (18);
a blocking device (22, 24, 26) fixing said rotor in position relative to said drive shaft (104) of said centrifuge (100);
an activating element (74, 36) mounted in said lid (40) for activating said blocking device (22, 24, 26);
said activating element (74) includes a far end protruding outside of said lid (40) when said lid (40) is mounted concentrically in said receiving chamber;
said blocking device (22, 24, 26) includes a blocking unit (26) which is movable between a blocking position and a releasing position by said activating element (74, 36);
said activating element (74, 36) releasing said blocking device from said blocking position to said releasing position, said far end of said activating element (74, 36) includes a pushbutton (82) thereon;
a handle (44) resides on said remote side of said lid facing away from said receiving chamber (18) for carrying said rotor and said lid (40);
said pushbutton (82) is outside said handle (44) when said blocking unit (26) is in said blocking position;
said lid includes a locking mechanism (50, 34*b*) for locking said lid (40) and said rotor;
said locking mechanism (50, 34*b*) comprising:
a locking element (50) movable between a locking position and an unlocking position thereof (50); and, a retaining element (48*b*, 48*c*);
a part of said handle (44) is adapted to be movable and is operatively connected to said retaining element (48*b*, 48*c*); and,
said retaining element (48*b*, 48*c*) movable by said handle between a first position which prevents actuation of said locking element (50) and a second position which releases said locking element (50).

2. A centrifuge (100), comprising:

a rotor (10);

a drive;

a drive shaft (104);

said drive shaft (104) includes a free end;

a support (106) mounted on said free end of said drive shaft (104);

said rotor includes:

a receiving chamber (18) for samples to be centrifuged;

said receiving chamber (18) includes a top;

a concentric seat (20);

said concentric seat (20) of said rotor is mounted on said support (106) mounted on said free end of said drive shaft (104) of said centrifuge 100);

a lid (40);

said lid (40) limits said receiving chamber (18) at said top, said lid (40) is mounted concentrically relative to said rotor;

a blocking device (22, 24, 26) having a blocking body (22) interacting with a blocking unit (26) fixing said rotor (10) to said drive shaft (104);

said blocking body (22) is mounted on said seat (20) of said rotor and engages said support (106) through a recess (110) in said support (106) and, in a locking position, said blocking body (22) is embraced by said blocking unit (26) and an outer circumference of said blocking unit (26) embracing said blocking body (22) is larger than an inner circumference of said recess (110);

a handle (44) on a remote side of said lid from said receiving chamber (18) for carrying said rotor and said lid (40);

said lid includes a locking mechanism (50, 34*b*) for locking said lid (40) and said rotor;

said locking mechanism (50, 34*b*) comprising:

a locking element (50) movable between a locking position and an unlocking position thereof (50);

a retaining element (48*b*, 48*c*);

a part of said handle (44) is adapted to be movable and is operatively connected to said retaining element (48*b*, 48*c*); and, said retaining element (48*b*, 48*c*) is movable between a first position which prevents actuation of said locking element (50) and a second position which releases said locking element (50).

* * * * *